United States Patent [19]

O'Neill

[11] 4,211,220

[45] Jul. 8, 1980

[54] DIVING HELMET ASSEMBLY

[75] Inventor: Wilbur J. O'Neill, W. Severna Park, Md.

[73] Assignee: Diver's Exchange, Inc., Harvey, La.

[21] Appl. No.: 8,930

[22] Filed: Feb. 2, 1979

[51] Int. Cl.[2] ..... B63C 11/06

[52] U.S. Cl. ..... 128/201.27; 128/201.28; 128/201.29; 128/204.26; 128/204.29; 128/205.19; 128/205.24

[58] Field of Search ..... 128/142.3, 142 R, 142.2, 128/142.5, 142.7, 141 R, 146 R, 145 R, 145 A, 146.7; 405/186

[56] References Cited

U.S. PATENT DOCUMENTS

| | | | |
|---|---|---|---|
| 2,792,832 | 5/1957 | Galeazzi | 128/142.5 |
| 2,882,895 | 4/1959 | Galeazzi | 128/142 R |
| 3,370,585 | 2/1968 | O'Neill | 128/142.2 |
| 3,968,794 | 7/1976 | O'Neill | 128/142.3 |

FOREIGN PATENT DOCUMENTS

| | | | |
|---|---|---|---|
| 259934 | 5/1913 | Fed. Rep. of Germany | 128/142.3 |

*Primary Examiner*—Henry J. Recla
*Attorney, Agent, or Firm*—Llewellyn A. Proctor

[57] ABSTRACT

In an improved diving helmet, or diving helmet assembly, of the type having a seal characterized as a flexible diaphragm, usually an annular diaphragm which seals about the diver's neck to close off the helmet and provide an interface between the water and the diver's breathing gas, improvements characterized as means associated with said flexible diaphragm for sensing changes in the physical position of said diaphragm caused by the differential pressure between said ambient water pressure and said helmet pressure, and actuating means responsive to said sensing means for opening and closing a valve to regulate helmet gas pressure. The said actuating means is located in said gas supply inlet for regulating the flow of breathing gas into the helmet or in said gas exhaust outlet for regulating the flow of exhaust gas from the helmet, or both, such that the ingress or egress of gas to or from the helmet is regulated and directly proportioned to the differential pressure sensed by the flexible diaphragm.

10 Claims, 7 Drawing Figures

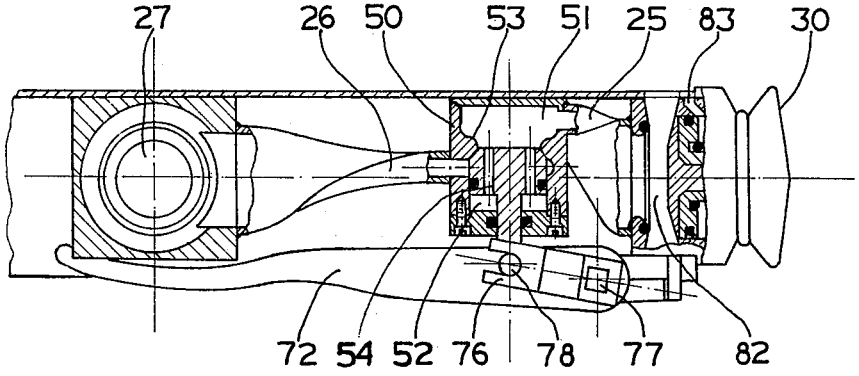
FIG. 6.
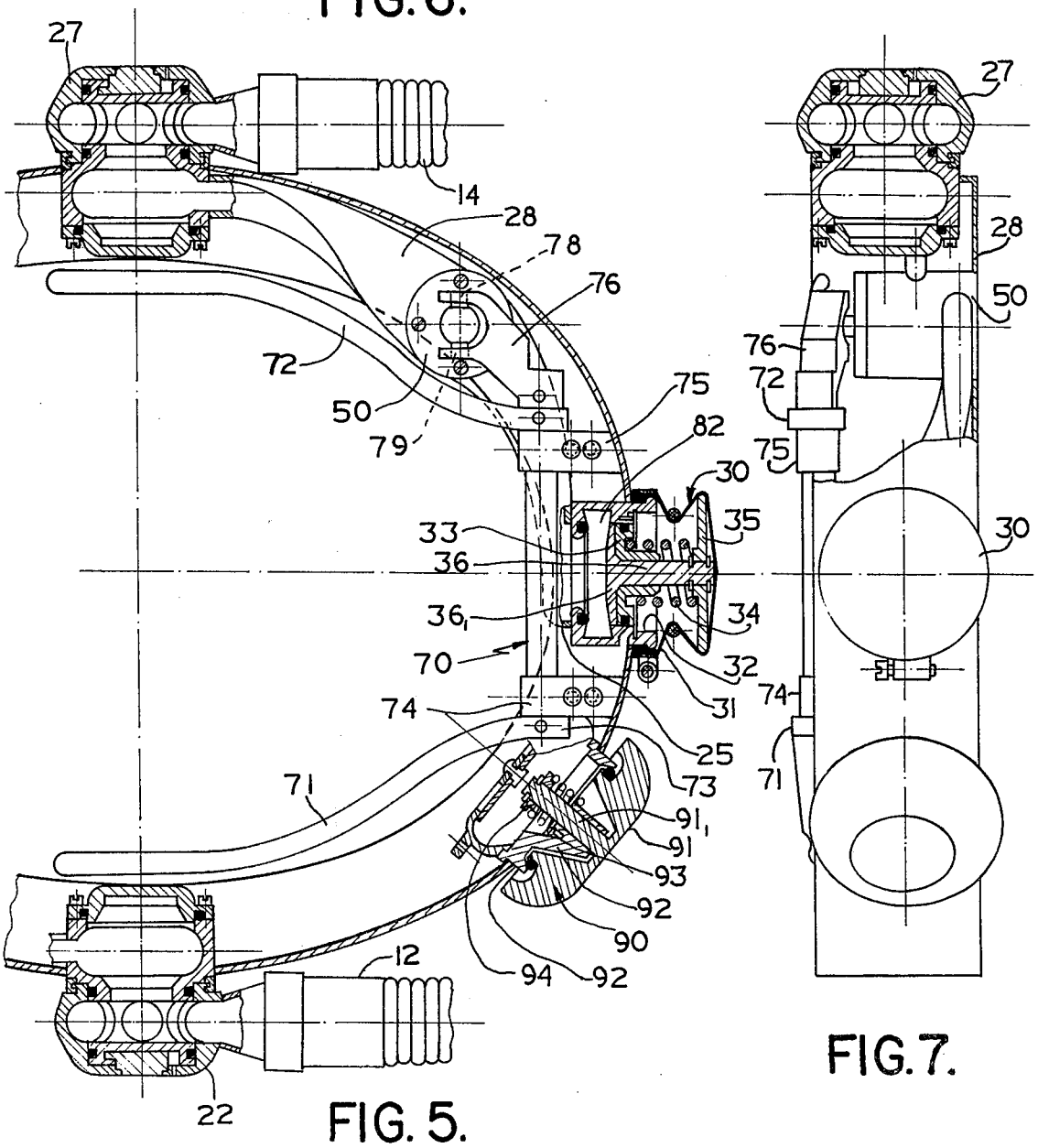
FIG. 5.
FIG. 7.

DIVING HELMET ASSEMBLY

Diving helmets in most conventional deep water systems provide the necessary interface between a diver and his breathing gas supply source. The helmet includes, inter alia, a window and a suitable sealing arrangement, most commonly a seal comprised of an elastomeric diaphragm which seals upon the neck of the diver to maintain gas integrity. The breathing gas is generally supplied from a remote source, e.g. a diving bell, directly to the diver's helmet via a flexible hose, and recent developments have provided means for returning the exhaust gas to the remote source via a second flexible hose. The breathing gas, in the latest systems which have been developed for commercial use, is circulated via pumping at power adequate to provide supply and return pressures sufficient to overcome the dynamic pressure losses in the circulatory system which delivering gas to the diver at his deepest depth and adequate to induce return flow at his shallowest depth. An advanced push-pull pumping system and means for controlling the differential between the supply and return pressures virtually constant, is described in U.S. Pat. No. 3,965,892.

In push-pull systems, the submerged diver is supplied with breathing gas at some given pressure which must not require too large of an expenditure of inspiratory or expiratory effort. Such expenditures cause breathing discomfort and lung fatique, and if too excessive can suppress the removal of carbon dioxide from the diver's lungs. Any such expenditure of energy consumes useful energy and lessens the diver's normal capacity to work, or capacity to meet emergency situations; and, at the extreme too much exertion can totally deplete such capability, and even produce death. Consequently, recent developments in diving equipment has placed emphasis on further reducing, and maintaining the pressure of the breathing gas within comfortable limits for the diver to lessen lung fatigue.

One such diver-worn apparatus for controlling the supply pressure within comfortable limits for the diver is described in U.S. Pat. No. 3,841,348. The apparatus described therein is characterized generally as an underwater breathing system exhaust valve provided with an aperatured movable diaphragm, and adjustable spring which acts on said diaphragm to close and maintain the latter closed against a valve seat. A counterpoise, or weight, connected to the diaphragm opposes or aids the spring in maintaining the valve closed in accordance with the positional orientation of the valve which in turn is caused by the positional orientation of the diver.

A diver-worn helmet which functions to maintain the pressure of the breathing gas within comfortable limits for the diver is also described in U.S. Pat. No. 3,968,794. The helmet includes input and output connections for receiving breathing gas from and recycling same to a remote source, and valve assembly integral with the helmet. The breathing gas from the remote source is supplied through a series arrangement of a normally open fail-safe valve and an exhaust control valve which maintains the helmet pressure within predetermined limits relative to the ambient water pressure. The fail-safe valve is actuated on decrease of the helmet pressure to a dangerous level, as occurs on failure of the exhaust valve. Valve activation is a function of diver position, or orientation, within a range which minimizes diver breathing effort at different diver positions.

In conventional underwater breathing systems spring loaded exhaust valves are used to maintain a predetermined helmet pressure relative to the ambient water pressure. Such systems are particularly diver orientation sensitive and require undesirable inspiratory or expiratory effort. An accepted theory is that the ideal pressure of the gas supplied to the submerged diver should at all times be equal to that of the plane of depth of the water at the lung centroid. A discussion of this anatomical reference point and its import in the design and use of underwater breathing systems, and a description of diver-worn apparatus which is designed to maintain the supply pressure at the diver's helmet as nearly as possible with that of the lung centroid of the diver is given in said U.S. Pat. Nos. 3,841,348 and 3,968,794, supra. Whereas the diving apparatus described therein, approximates to an admirable degree the hydrostatic pressure acting on a diver's body at this physiologically desirable anatomical reference point, the deviations from ideal are nonetheless considerable when the diver's body is in right or left side down positions. A principal reason for this is that the conventional demand, and spring loaded diaphragm exhaust valves are located off to one side of the helmet. Thus, it has not been considered possible to make the supply pressure coincide precisely with that of the lung centroid for all diver positions.

A preferred theory suggests that the ideal supply pressure within the diver's helmet should at all times equal that behind the superasternal notch, or notch located at the top of the sternum or breast bone. For the average sized adult male this is a point located approximately 19 centimeters above, and 7 centimeters forward of the lung centroid. In diver head up or down positions, due to a psychologically noisome effect referred to as "piston effect," it is desirable to change the gas supply pressure to that of the plane of depth of the superasternal notch. The piston effect is the force which tends to lift the helmet off the diver's head due to the outward pressure differential across the neck seal on expiration; and, conversely, the inward pressure differential across the neck seal on inspiration which tends to push the helmet more firmly onto the diver's head.

It is, accordingly, a primary objective of the present invention to provide a novel diving helmet, or diving helmet assembly, for providing more optimum breathing gas pressures.

A particular object is to provide a novel diving helmet, or diving helmet assembly, which suppresses and utilizes to advantage the piston effect to lessen respiratory overpressure/underpressure effects in all diver positions.

These objects, and others, are achieved in accordance with the present invention which comprises an improved diving helmet, or diving helmet assembly, to which breathing gas is supplied via a supply inlet, and exhaust gas is removed via an exhaust outlet, of the type having a seal characterized as a flexible diaphragm which closes off the helmet and provides an interface between the water and the diver's breathing gas, the flexible diaphragm being utilized to sense movements caused by the pressure differential between the ambient water pressure on one side of the diaphragm and the helmet gas on the other, and actuate a valve to regulate helmet gas pressure. The said actuating means operates a valve which is located in said gas supply inlet for regulating the flow of breathing gas into the helmet, or in said gas exhaust outlet for regulating the flow of exhaust gas from the helmet, or both. The novel helmet improves pressure control and simultaneously reduces piston effect. It also provides more comfortable conditions for the diver.

In its preferred aspects, the movements of the diaphragm are transmitted by a mechanical, pneumatic or hydraulic linkage which is used to regulate the said breathing gas supply or exhaust control valve, or both. A preferred type of mechanical linkage is comprised of a lever arm, or pair of lever arms convergent at one end and divergent at the other, one end (e.g. the convergent end) of which is pivotally attached to the helmet shell, the other (e.g. the divergent end) of which is in contact with or secured to the diaphragm and a section or portion extending therefrom is maintained in operative contact, or secured to mechanism for opening and closing said valve.

The characteristics of a preferred diving helmet, or diving helmet assembly, and its principle of operation, will be more fully understood by reference to the following detailed description, and to the attached drawings to which reference is made in the description. Components of the diving system interrelated with the diving helmet, or diving helmet assembly, and the diving helmet itself are referred to in terms of reference numerals, similar numbers being used in the different figures to designate similar components. In describing certain components, and features thereof, subscripts have also been used with whole numbers for convenience to describe subcomponents of said component part.

In the drawings:

FIG. 5 shows in partial section a bottom plan view of the details of the neck seal actuatable exhaust valve mechanism for opening and closing said exhaust control valve for maintaining the helmet pressure within comfortable limits;

FIG. 6 depicts in partial section a left side elevation view of the neck seal actuatable exhaust control valve mechanism shown in FIG. 5; and FIG. 7 depicts in partial section a front view of the neck seal actuatable exhaust control valve mechanism.

Figure 1:
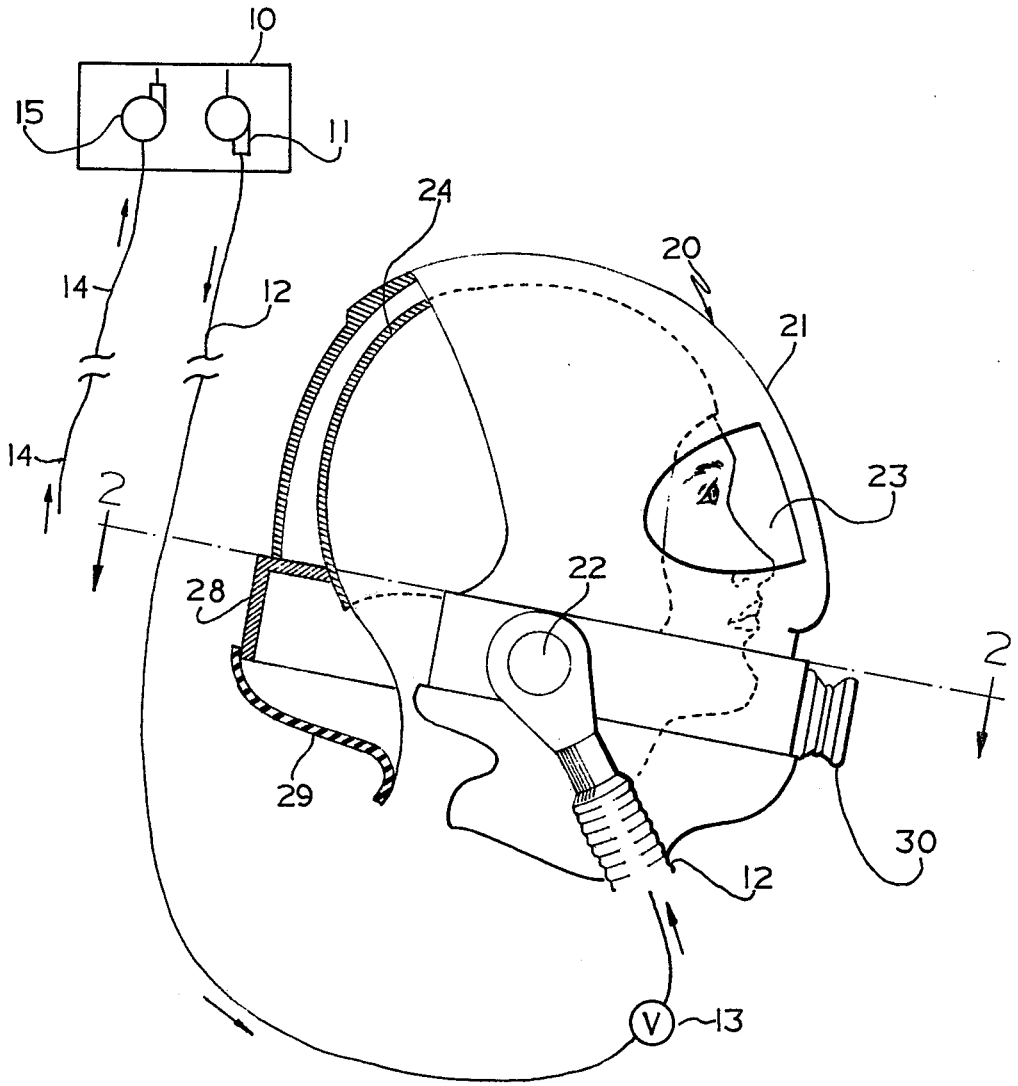
FIG. 1 depicts, in partial section, a right side elevation view of a preferred diving helmet, or diving helmet assembly in combination with a breathing gas supply source, shown schematically.

Referring to FIG. 1, first generally, there is shown a diving helmet 20 comprised of an outer shell, or body 21 to the lower side of which is integrally fitted a valve ring, or valve ring casting 28; and the helmet contains an inner cavity within which the diver's covered head is fitted. The lowermost side of the helmet 20 is provided with a seal characterized as an annular flexible diaphragm 29, through which the diver's body is snugly fitted, usually at the neck level, to hermetically shut off or seal the helmet from the ambient water. In its preferred form the flexible diaphragm 29 is attached at the level of the diver's neck, as such, forming a neck-seal to provide an interface between the water and the diver's air supply. The helmet 20 is supplied with breathing gas from a remote source 10, e.g. a diving chamber or bell, via a suitable inlet connection 22 at the right side of the helmet by means of a pump 11 and flexible supply hose 12, suitably through a check valve 13; and exhaust gas from the diver's lungs exhaled into the helmet is returned to the source 10 via a suitable outlet connection at the left side of the helmet and flexible hose 14 with the aid of suction pump 15.

The outer shell 21 of the helmet is provided with a recessed portion along the side and upper part thereof to provide a duct, or space for the introduction of breathing gas via swivel connection 22 for ascent, and subsequent downward passage across the diver's face. In other words, the inside face of shell 21 is nominally contoured to fit the diver's padded head, but space is provided inside the face of the shell and between the outer surface of the inner helmet or adapter 24 to provide a portion of the duct work required within the helmet to permit the introduction of breathing gas. The design of the helmet can be quite varied, as can be adapter 24 which is padded to form a precise fit with the diver's head. The features of a suitable adapter unit for use with the helmet are given in some detail in U.S. Pat. No. 3,995,627, herewith incorporated by reference. The shell 21 of the helmet 20 also serves as a base within which various other components can be mounted, particularly fittings which facilitate the introduction of breathing gas, and discharge of exhaust gas.

Figure 2:
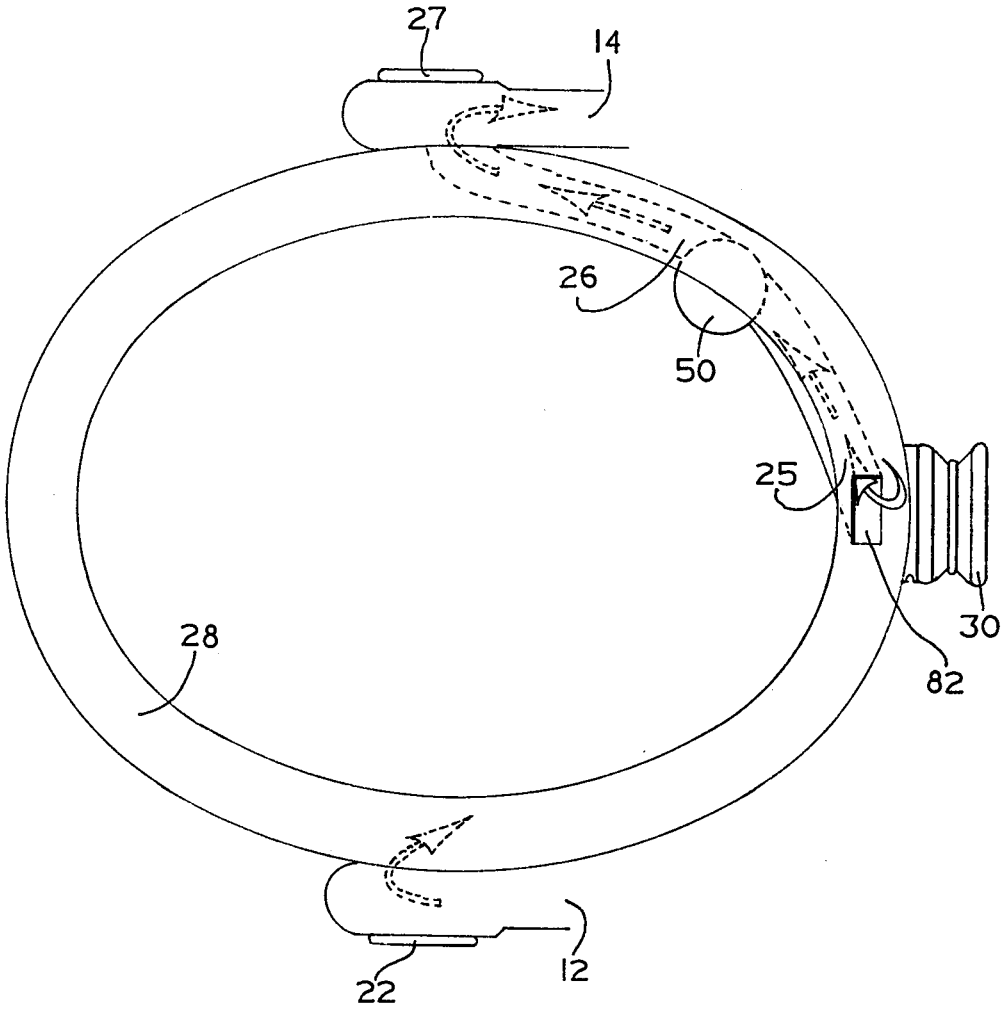
FIG. 2 depicts a section taken through Section 2—2 of FIG. 1 of said helmet, showing in series a fail-safe valve and exhaust control valve.

Breathing gas is exhausted from the helmet 20 through a series of valves, viz. a normally open fail-safe valve 30 and an exhaust control valve 50 as generally described by direct reference to FIG. 2. However, first by reference to FIG. 1, breathing gas is supplied to the helmet 20 through flexible hose 12 to the swivel hose inlet connection 22, the gas passing through the duct work in shell 21 of the helmet, passing downwardly across the diver's face and window 23. This gas is taken into the diver's lungs and then exhaled. The exhaled gas, as best shown by direct reference to FIG. 2, is passed through the normally open fail-safe valve 30 via the open passageway 82 and then transferred via the passage 25 through the exhaust control valve 50 from where it is transferred via passageway 26 to the flexible hose 14 adjoined to the helmet 20 at the swivel outlet connection 27. The fail-safe valve 30 and exhaust control valve 50, inclusive of the connecting tubing 25, 26 providing the passageway for transfer of the exhaust gas to the helmet exterior, it will be observed, is mounted on a valve ring or valve ring casting 28 of angular cross section. A flexible diaphragm 29, open through its center, is mounted on the lower side of the valve ring 28, for forming a seal upon the diver's body, suitably upon the diver's neck.

The neck seal 29 provides a hermetically, and water tight seal between the helmet 20 and the ambient water. The neck seal in all embodiments is comprised of a flexible membrane which, in use, is pressurized on the one side by the gas inside the helmet, and on the other side by the ambient water pressure. Whereas in previous helmets conventional demand and spring loaded diaphragm valves have been located to one side or the other of the helmet, the neck seal or diaphragm 29 is utilized in the present invention as a device to sense the differential pressure between the helmet gas and ambient water, movements of the diaphragm in response to said differential pressure being utilized via an appropriate mechanism which moves in direct response thereto to open and close a valve to optimize, control and regulate the gas pressure of the helmet, e.g. a breathing gas supply valve or an exhaust control valve, or both. The location of the neck seal, or diaphragm, is one which provides a mechanical center which substantially coincides with the center line of the diver's body to sense ambient water pressure in all diver positions at a plane of depth corresponding substantially with the plane of depth of the superasternal notch.

Figure 3:
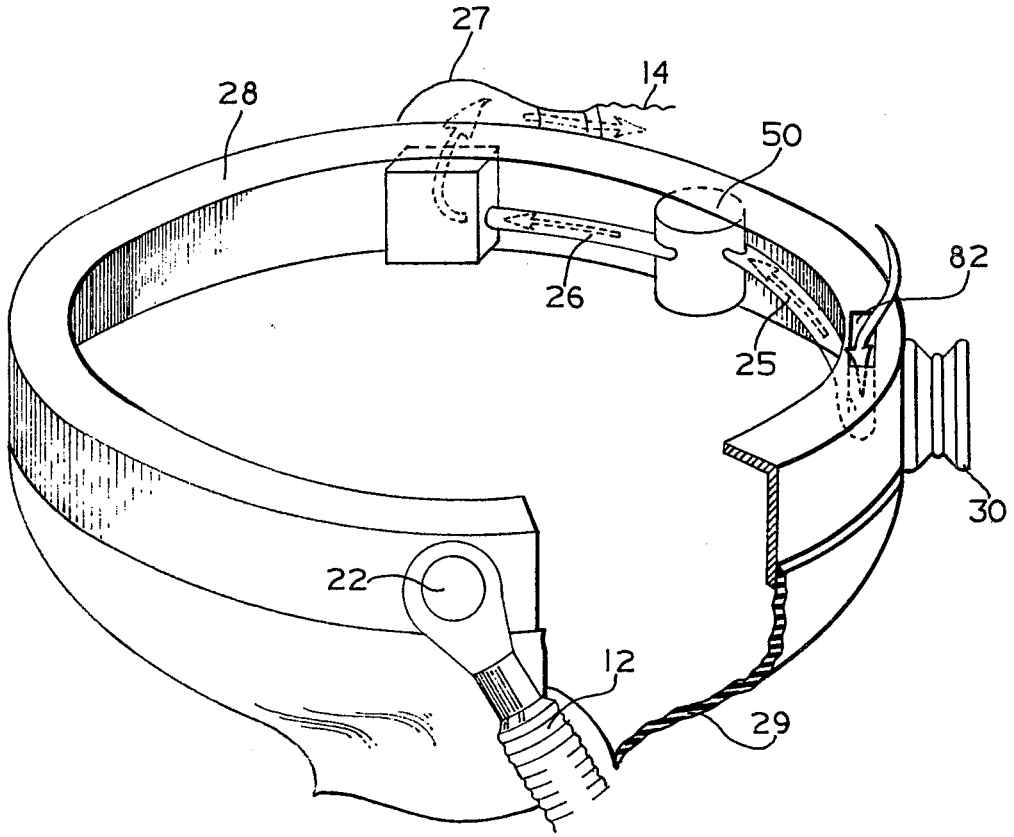
FIG. 3 depicts isometrically, and in partial section, a view of the lower portion of the diving helmet showing said series of valves positioned on a valve ring, or valve ring casting.
Figure 4:
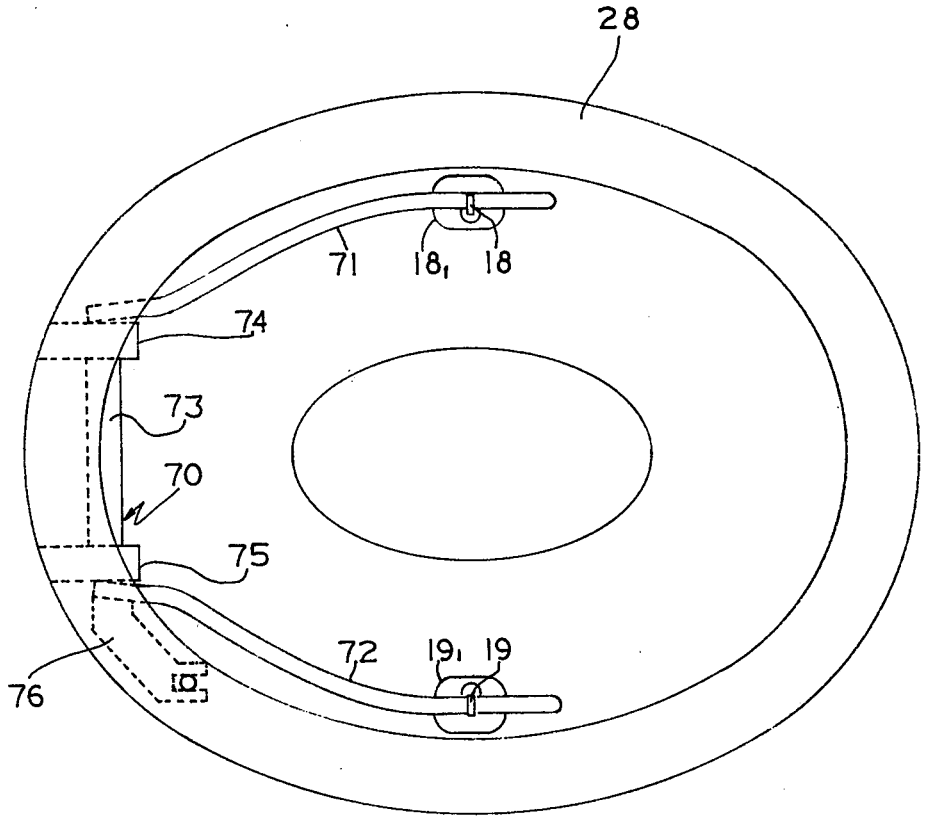
FIG. 4 depicts, in a plan view, the lower portion of the helmet, inclusive of said valve ring, or valve ring casting, on which is affixed mechanism which, in combination with a neck seal, actuates and regulates the exhaust control valve.

Referring to FIG. 3, there is shown a rigid valve ring 28 of angular cross section, a flat side of which is faced upwardly to provide a base to which the shell portion of the diving helmet 20 is adjoined; the shell portion of the diving helmet 20, and that mechanism shown in FIG. 4, not being shown in this figure so that certain of the internal features thereof can be shown in better perspective. The neck seal, or flexible diaphragm 29 is circumferentially sealed upon the lower outwardly faced flat side of the valve ring 28, the lower portion of the diaphragm being reduced to fit, and seal snugly upon the neck of the diver. In effect therefore, the flexible diaphragm 29 tapers inwardly, fits upon and is sealed about the neck of the diver in the vicinity of the superasternal notch. The lower face of the diaphragm forming the neck seal is thus in contact with and subjected to the ambient water pressure when the diver is submerged, and the upper or helmet side of the diaphragm is in contact with and actuated by the gas pressure within the helmet. On expiration by the diver, a portion of the exhaust gas passes through the fail-safe valve 30, enters into the opening leading through the passageway 25, exhaust valve 50, and passageway 26 leading via the swivel hose attachment 27 to the flexible hose 14, but simultaneously the increased pressure caused by expiration pushes downwardly on the diaphragm 29 to move it slightly outwardly; and on inspiration the reduced helmet gas pressure permits the pressure of the ambient water to move the diaphragm 29 slightly inwardly.

The inward and outward movement of the diaphragm 29 caused by the inhalations and exhalations of the diver is employed to actuate, or open and close a valve, viz. a supply valve or exhaust control valve, or both, as desired to maintain the helmet pressure within comfortable limits. A preferred type of mechanical linkage actuated by the diaphragm 29 of the neck seal assembly employed to open and close an exhaust valve 50 for this purpose is described by reference to FIGS. 4 through 7.

Referring to FIGS. 4 through 7, first to FIG. 4 for convenience, there is shown a bifurcated, wishbone shaped, or yoke-like lever mechanism 70 mounted on the lower edge of valve ring 28. The mechanism 70 is generally comprised of alternately disposed lever arms 71, 72, an end of each of which is rigidly adjoined or pinned to an axle 73 which is journalled within a pair of fixed blocks 74, 75 mounted upon the lower edge of valve ring 28, and alternately disposed on opposite sides of the fail-safe valve 30. Each of the lever arms 71, 72 extends on each side of the central opening of the diaphragm 29, normally occupied by the diver's neck, and the free end of each is tilted downwardly, impinges upon and is secured via ring clamps 18, 19 to the diaphragm 29 at about a point thereof which provides adequate movements inwardly and outwardly with the inhalations and exhalations of the diver. A relatively short bell crank arm 76 is rigidly affixed via the pin 77 to lever arm 72 near the location wherein it is adjoined to axle 73, and the free end thereof is bifurcated in both the vertical and horizontal planes, one pair each of the four separated fingers formed thereby extending around and gripping the trunnion-like pins 78, 79, respectively, of exhaust valve 50. Diaphragm movements transmitted to the lever arms 71, 72 causes corresponding movements of the bell crank arm 76 to thereby open, close and regulate flow through the exhaust control valve 50 by reciprocal movement of the poppet 54 of exhaust valve 50.

The ring clamps 18, 19 are each provided with a base portion 18', 19', respectively, which attaches directly to the diaphragm 29 on opposite sides of the central opening thereof. The effective area on which the helmet gas acts on the diaphragm is substantially represented by the sum total surface area of the base portions 18', 19'. Suitably, the effective helmet gas pressure operating on the diaphragm can be reduced by reducing the sum total area of their base portions 18', 19'; or conversely, can be increased by increasing the sum-total area of base portions 18', 19'. Another method for increasing the effective area is to incorporate a stiff ring member, of the desired total surface area, concentric with the central opening within diaphragm 29.

In diver positions other than horizontal the yoke-like member 70 offers advantages over the use of a single lever arm mechanism in that differential pressures caused by different pressures applied on opposite side of the diver's neck are averaged. This provides better stability, and more even helmet pressure changes when the head of the submerged diver is tilted from horizontal.

With specific reference to FIG. 6 it will be observed that the exhaust control valve 50, is comprised of a relatively large chamber 51 and smaller chamber 52. Pressure between the two chambers is equalized, and the chambers are separated by a constricted ring portion 53, one face of which provides a seat for the face of the enlarged perforated head of poppet member 54. The poppet member 54, when seated within the ring 53 cuts off the flow of gas, and on being unseated permits flow of gas via the opening, or chamber 82, to the relatively large chamber 51 of the valve 50 via passageway 25, the gas flowing across a face of the unseated head of poppet number 54 to enter passageway 26 from where it is conducted via swivel connection 27 to flexible hose 14. Movement of the free end of lever arm 72 produced by inhalation of the diver will thus tilt the bell crank arm 76, which consequently will close exhaust valve 50 by pushing the poppet member 54 into a seating position. Conversely, movement of lever arm 72 in the opposite direction caused by exhalation of the diver will cause a corresponding movement of the bell crank arm 76 which will cause the poppet member 54 to unseat and thereby open the exhaust valve 50.

In normal operation therefore, the fail-safe valve 30 remains open. Breathing gas pumped into the helmet 20 via hose 12 and swivel attachment 22 is passed downwardly across the diver's face. On expiration of gas from the diver's lungs the pressure inside the helmet 20 is increased, this increasing the pressure on diaphragm 29 so that it overcomes the opposing ambient water pressure on the opposite side of the diaphragm and moves the diaphragm outwardly from the helmet. Such movement of the diaphragm 29 causes the free ends of the lever arms 71, 72 to move outwardly; and the corresponding movement of the bell crank arm 76 causes the poppet member 54 to unseat. This causes the exhaust valve 50 to open, and exhaust gas from helmet 20 enters the opening of chamber 82 of the fail-safe valve 30. Exhaust gas from the helmet flows through passageway 25, over the face of the unseated poppet member 54 of exhaust valve 50, entering into passageway 26 from which it egresses via flexible hose 14 for return to the supply source. Conversely, inhalation of breathing gas from the helmet 20 into the diver's lungs reduces the pressure inside the helmet 20, thus permitting the ambient water pressure to push the diaphragm 29 inwardly. This in turn causes a directionally corresponding movement of lever arms 71, 72 and a corresponding movement of bell crank arm 76. Movement of the bell crank arm 76 pushes the poppet member 54, causing it to seat and close the exhaust valve 50.

Fail-safe valves per se and the manner in which they are operated are known, and described in U.S. Pat. No. 3,968,794, supra, herewith incorporated by reference. The fail-safe valve functions to protect the diver during failure of the primary exhaust control valve, should this occur. In the system described, breathing gas is thus normally supplied from a remote source and returned thereto through a series combination of a fail-safe valve 30 and exhaust control valve 50, as heretofore described, this being adequate to maintain the helmet pressure relative to the ambient water pressure within comfortable pre-selected limits. In normal operation, the fail-safe valve 30 remains open. Should however the exhaust control valve 50 fail in open position such that the pressure in helmet 20 drops too low, the fail-safe valve 30, is designed to close, so that exhaust gas is diverted to overpressure/water dump valve 90.

The fail-safe valve 30 is constituted of an outer cap or cover 31 of flexible material, e.g. an elastomeric material, which is secured tightly upon the forward-projecting portion of the rigid tubular body 32 which is mounted within, and extended through the forward side of ring 28 to form an integral part of helmet 20. The forward end of tubular body 32 is fitted with a circular shaped, outwardly projecting open centered nozzle, i.e. a stem retainer 33, the forward face of which is provided with a seat for helical spring 34. It is seated in place in the nozzle 33 via O-rings to form a gas and water tight seal, and a stem 36 is slidably fitted therein. The outward side of stem 36 is provided with an open center circular plate 35, and the forward end of stem 36 is rigidly affixed therein. The rearward face of the plate 35 provides a second seat for the helical spring 34. The forward end of stem 36 is spring biased outwardly, and a retainer ring holds the cover 31 crimped inwardly. The opposite end of said stem 36 is of size sufficient to fit into and seal the entrance, or mouth of passageway 25 when it is projected therein. The stem 36, as mentioned, is spring biased outwardly but depressurization of the helmet will permit the stem 36 to shift inwardly to close passageway 25; or the passageway 25 can be manually closed by pushing the stem 36 inwardly.

The overpressure/water dump valve 90, which in normal operation is closed, is constituted of an outer circular cover member or disk shaped cover 91 which bears against the seal-edge, or seating surface of a tubular body member 92 mounted within the valve ring 28, or shell of the helmet 20. The tubular body 92 is also provided with an outwardly projecting nozzle connected via a webbed portion to the main cylindrical body portion of said member 92, and thereupon is mounted the outwardly slidable disk cover 91 which contains a stem 91, which is extended through the central opening of said nozzle portion 92. The inside face of the disk cover 91 is slotted to mate with the external surface of the nozzle portion 92 to provide stability. The disk cover 91 is biased in closed position by the action of a helical spring 93 which is seated between the notch at the inside face of disk cover 91 and a small disk or spring bearing plate 94 secured to the terminal end of stem 91. In normal operation, as suggested, the overpressure/water dump valve 90 is closed. On overpressurization, however, the disk cover 91 is forced outwardly to overcome the action of the spring 93, this action permitting exhaust gas to pass from the inside of helmet 20 to the ambient water. Also, the valve 90 can be manually operated by the diver by deliberate overpressurization to dump water from the helmet.

In its normal function, exhaust gas is passed from the helmet through the open fail-safe 30 to egress via flexible hose 14 for return to the remote source. If however the exhaust control valve 50 should fail, as in an open position the pressure in passageway 25, 26 will drop and the helmet 20 will be depressurized. Should this type of malfunction occur, the lowered pressure will permit the action of helical spring 34 of fail-safe valve 30 to be overcome by the differential pressure operative across the front of the valve, and the enlarged portion 36, of shaft 36 will move rearward and close passageway 25. This occurring, exhaust gas would then be diverted to the overpressure/water dump valve 90 and exhausted into the ambient water.

It is apparent that various modification and changes can be made without departing the spirit and scope of the invention. Whereas the neck seal mechanism has been described as operating an exhaust control valve, the mechanism can also be employed to operate a gas supply valve, or both. In this mode, the breathing gas would be supplied directly into the helmet at optimum pressure through a controlled gas supply valve. Overpressurization would be prevented by partial closure of the supply valves, and underpressure prevented by opening to provide an increased volume of breathing gas through the supply valve. Failure of the supply valve in a manner causing overpressurization would be corrected exhaust or gas to an overpressure/water dump valve.

Equally it is apparent that various mechanical, pneumatic or hydraulic linkages can be used in conjunction with the neck seal to actuate exhaust control valves or supply valves, or both.

It is also apparent that various modifications and changes, such as in the absolute or relative dimension of the parts, materials of construction used, and the like are well within the skill of those knowledgable in this art.

Having described the invention, what is claimed is:

1. In a helmet of the type worn by a diver for underwater breathing, said helmet being characterized as having a shell provided with an internal cavity and access opening thereto through which and into which a portion of a diver's body can be fitted, a breathing gas supply inlet through which a breathing gas can be introduced into the helmet for inspiration into the diver's lungs, and exhaust gas outlet through which gas can be exhausted from the helmet, valve means controlling the flow of gas from said inlet to said outlet, and a flexible diaphragm provided with an opening therethrough which is secured in the access opening to the helmet cavity, the diaphragm adapted to cover and seal the annular space between the body of the diver and the helmet to provide an interface between the water and the diver's breathing gas supply, one side of the diaphragm, when the diver is submerged, being in contact with ambient water while the other is in contact with gas supplied to the inside of the helmet, the improvement which comprises a means associated with said flexible diaphragm for sensing changes in the physical position of said diaphragm with respect to said helmet caused by the differential pressure between said ambient water pressure and said helmet gas pressure, and an actuating means responsive to said sensing means for opening and closing said valve means as a function of said pressure differential whereby the ingress or egress of gas to or from the helmet is regulated, and directly proportioned to the differential pressure sensed by the flexible diaphragm forming said seal.

2. The apparatus of claim 1 wherein the sensing member associated with said flexible diaphragm is a lever arm, one end of which impinges upon the flexible diaphragm, the other of which is pivotally attached to a portion of the helmet, and the actuating means for opening and closing said valve is a projecting member extending from said lever arm, and movable in unison therewith.

3. The apparatus of claim 1 wherein the sensing member associated with said flexible diaphragm is a yoke-like member, the convergent end of which is pivotally attached to a frame integral with the shell of the helmet, the divergent ends of which impinge upon alternate sides of the opening through said flexible diaphragm, and the actuating means for opening and closing said valve is a projecting portion attached to one of the arms of said yoke-like member, extending therefrom, and movable in unison therewith.

4. The apparatus of claim 3 wherein the yoke-like member is located on the lower side of the frame, the divergent ends of the yoke-like member which impinge upon the flexible diaphragm are appended thereto, and the convergent ends of said yoke-like member are pivotally secured to an axle journalled upon the frame of the helmet.

5. The apparatus of claim 1 wherein the diver's head and a portion of his neck can be extended through the opening of the flexible diaphragm into the helmet, and the flexible diaphragm seals upon the neck of the diver.

6. A helmet of the type worn by a diver for underwater breathing, which comprises:

a shell having an internal cavity nominally shaped to conform to a diver's head, and an access opening through which a diver's head and a portion of a diver's neck can be fitted and covered, a breathing gas supply inlet through which breathing gas can be supplied to the helmet, an exhaust gas outlet through which gas can be exhausted from the helmet, an exhaust gas control valve located within said exhaust gas outlet, a flexible diaphragm provided with an opening therethrough secured to the access opening to the helmet, the diaphragm adapted to cover and seal the annular space between the diver's neck and helmet when the helmet is placed upon the diver, thus providing an interface between the water and the diver's breathing gas supply, one side of the flexible diaphragm, when the diver is submerged, being in contact with the ambient water while the other side is in contact with the helmet gas, a means associated with said flexible diaphragm for sensing changes in the physical position of said diaphragm with respect to said helmet caused by the differential pressure between said ambient water pressure and said helmet gas pressure, and actuating means responsive to said sensing means for opening and closing the exhaust gas control valve as a function of said pressure differential located at said exhaust gas outlet, whereby the egress of gas from the helmet is regulated and proportioned to the differential pressure sensed by the flexible diaphragm forming said neck seal.

7. The apparatus of claim 6 wherein the exhaust gas outlet of the helmet includes a fail-safe valve in series with said exhaust control valve, and the helmet further includes an overpressure/water dump valve to which exhaust gas can be diverted on overpressurization of the helmet caused by failure of the exhaust control valve.

8. The apparatus of claim 6 wherein the sensing means is a lever arm, one end of which impinges upon and is associated with said flexible diaphragm, the other of which is pivotally attached to a portion of the helmet, and the actuating means for opening and closing said exhaust control valve is a projecting member extending from said lever arm, and movable in unison therewith.

9. The apparatus of claim 6 wherein the sensing member associated with said flexible diaphragm is a yoke-like member, the convergent end of which is pivotally attached to a frame integral with the shell of the helmet, the divergent ends of which impinge upon alternate sides of the opening through the flexible diaphragm, and the actuating means for opening and closing said exhaust valve is a projecting member attached to one of the arms of said yoke-like member, extending therefrom, and movable in unison therewith.

10. The apparatus of claim 9 wherein the yoke-like member is located on the lower side of the frame, the divergent ends of the yoke-like member which impinge upon the flexible diaphragm are appended thereto, and the convergent ends of said yoke-like member are pivotally secured to an axle journalled upon the frame of the helmet.

* * * * *